US010924835B2

(12) United States Patent
Sun et al.

(10) Patent No.: US 10,924,835 B2
(45) Date of Patent: Feb. 16, 2021

(54) VOICE COLLECTION DEVICE

(71) Applicant: BEIJING SOGOU TECHNOLOGY DEVELOPMENT CO., LTD., Beijing (CN)

(72) Inventors: Zhiyu Sun, Beijing (CN); Walayiding Wailibieke, Beijing (CN); Peng Zhang, Beijing (CN)

(73) Assignee: BEIJING SOGOU TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/689,927

(22) Filed: Nov. 20, 2019

(65) Prior Publication Data

US 2020/0228888 A1 Jul. 16, 2020

(30) Foreign Application Priority Data

Jan. 10, 2019 (CN) ..... 2019 2 0045276 U

(51) Int. Cl.

| | |
|---|---|
| ***H04R 1/04*** | (2006.01) |
| ***H04R 5/027*** | (2006.01) |
| ***H04R 5/04*** | (2006.01) |
| ***H04R 1/08*** | (2006.01) |

(52) U.S. Cl.

CPC ..... *H04R 1/04* (2013.01); *H04R 1/08* (2013.01); *H04R 5/027* (2013.01); *H04R 5/04* (2013.01)

(58) Field of Classification Search

None

See application file for complete search history.

(56) References Cited

U.S. PATENT DOCUMENTS

| | | | | |
|---|---|---|---|---|
| 6,323,049 | B1 * | 11/2001 | Lee | H04R 19/016 438/106 |
| 8,605,919 | B2 * | 12/2013 | Awamura | H04R 31/006 381/174 |
| 2006/0140423 | A1 * | 6/2006 | Tanabe | H04R 19/016 381/174 |
| 2008/0165982 | A1 * | 7/2008 | Hankey | B29C 48/09 381/74 |
| 2011/0096951 | A1 * | 4/2011 | Lee | H04R 31/00 381/352 |
| 2013/0105952 | A1 * | 5/2013 | Fontana | H04R 19/04 257/659 |

(Continued)

*Primary Examiner* — Qin Zhu

(74) *Attorney, Agent, or Firm* — Anova Law Group, PLLC

(57) ABSTRACT

The present disclosure provides a voice collection device, comprising: a housing; a microphone assembly disposed inside the housing and including a microphone main body and a microphone circuit board; and a sealing structure disposed between the microphone assembly and an inner side of the housing and including a dust filter and a first adhesive layer. One side of the microphone circuit board is connected to the dust filter. The other side of the microphone circuit board is connected to the microphone main body. The microphone circuit board and the dust filter are bonded to the inner side of the housing. A sound hole is configured on the microphone main body. A first through-hole is configured at a position on the microphone circuit board corresponding to the sound hole. A second through-hole is configured at a position on the housing corresponding to the first through-hole.

16 Claims, 2 Drawing Sheets

(56) References Cited

U.S. PATENT DOCUMENTS

2014/0064542 A1* 3/2014 Bright ..... H04R 1/086
381/359
2015/0304753 A1* 10/2015 Loeppert ..... H04R 1/04
381/111

* cited by examiner

VOICE COLLECTION DEVICE

CROSS-REFERENCES TO RELATED APPLICATION

This application claims priority to Chinese Patent Application No. 201920045276.X, filed on Jan. 10, 2019, the entire content of which is incorporated herein by reference.

TECHNICAL FIELD

The present disclosure relates to the field of electronic product and, more particularly, to a voice collection device.

BACKGROUND

As the voice recognition technology persistently progresses, more and more electronic devices are performing various functions based on results of voice recognition. In one example, smart appliances are capable of voice controls based on the voice recognition. In another example, translation devices and translation pens are capable of language translation based on the voice recognition. The electronic devices are configured with a microphone and collect voices through the microphone.

The sound pickup performance of the microphone plays an important role in the accuracy of the voice recognition. The isolation of the sound pickup outside a main channel is an important design requirement of the sound pickup performance of the microphone. In the existing technology, a silicone seal is often used to suppress the sound pickup outside the main channel of the microphone. The electronic devices with high quality sound pickup become more and more popular, and dimension of the electronic devices is shrinking. The silicone seal exposes constraints of low space utilization and poor stability.

SUMMARY

The present disclosure provides a voice collection device to solve one or more problems described above.

One aspect of the present disclosure a voice collection device, comprising: a housing; a microphone assembly disposed inside the housing and including a microphone main body and a microphone circuit board; and a sealing structure disposed between the microphone assembly and an inner side of the housing and including a dust filter and a first adhesive layer. One side of the microphone circuit board is connected to the dust filter. The other side of the microphone circuit board is connected to the microphone main body. The microphone circuit board and the dust filter are bonded to the inner side of the housing. A sound hole is configured on the microphone main body. A first through-hole is configured at a position on the microphone circuit board corresponding to the sound hole. A second through-hole is configured at a position on the housing corresponding to the first through-hole. The dust filter is configured between the first through-hole and the second through-hole. The first through-hole, the second through-hole, and the sound hole together form a sound pickup main channel.

Optionally, one portion of the first adhesive layer is configured between the dust filter and the housing; and another portion of the first adhesive layer is configured between the microphone circuit board and the housing.

Optionally, one portion of the first adhesive layer is configured between the dust filter and the microphone circuit board; and another portion of the first adhesive layer is configured between the microphone circuit board and the housing.

Optionally, the microphone circuit board includes a flexible circuit board (FPC) and a reinforcing board. The FPC is attached to the reinforcing board. The microphone main body is mounted on the FPC. The reinforcing board is connected to the dust filter.

Optionally, the microphone circuit board also includes a second adhesive layer. The FPC is attached to the reinforcing board through the second adhesive layer.

Optionally, the voice collection device includes two microphone assemblies. The two microphone assemblies are distributed at two ends of the voice collection device.

Optionally, the microphone circuit board also includes a second adhesive layer. The FPC is attached to the reinforcing board through the second adhesive layer.

Optionally, the two microphone assemblies are located on a same side of the voice collection device and are separated by a pre-set distance.

Optionally, a quantity of the microphone circuit board is one. The microphone circuit board is connected to the two microphone main bodies respectively to form the two microphone assemblies.

The voice collection device provided by the embodiments of the present disclosure includes the housing, the microphone assembly disposed inside the housing, and the sealing structure disposed between the microphone assembly and the inner side of the housing. The microphone assembly includes the microphone main body and the microphone circuit board. The sealing structure includes the dust filter and the first adhesive layer. One side of the microphone circuit board is connected to the dust filter. The other side of the microphone circuit board is connected to the microphone main body. The microphone circuit board and the dust filter are bonded to the inner side of the housing. A sound hole is configured on the microphone main body. A first through-hole is configured at a position on the microphone circuit board corresponding to the sound hole. A second through-hole is configured at a position on the housing corresponding to the first through-hole. The dust filter is configured between the first through-hole and the second through-hole. The first through-hole, the second through-hole, and the sound hole together form a sound pickup main channel. Through bonding the microphone circuit board and the dust filter to the inner side of the housing, any gap other than the sound pickup main channel is sealed effectively. Thus, the voice collect device solves the problem that in the existing voice recognition device with high quality sound pickup, substantial compactness of the internal structure causes poor sealing effect by the silicone seal.

BRIEF DESCRIPTION OF THE DRAWINGS

To more clearly illustrate the technical solution in the present disclosure, the accompanying drawings used in the description of the disclosed embodiments are briefly described hereinafter. The drawings described below are merely some embodiments of the present disclosure. Other drawings may be derived from such drawings by a person with ordinary skill in the art without creative efforts and may be encompassed in the present disclosure.

DETAILED DESCRIPTION OF THE EMBODIMENTS

To make the foregoing objectives, features and advantages of the present disclosure clearer and more understandable, the present disclosure will be further described with reference to the accompanying drawings and embodiments. However, exemplary embodiments may be embodied in various forms and should not be construed as limited to the embodiments set forth herein. Rather, these embodiments are provided to fully convey the thorough and complete concepts of the exemplary embodiments to those skilled in the art.

Figure 1:
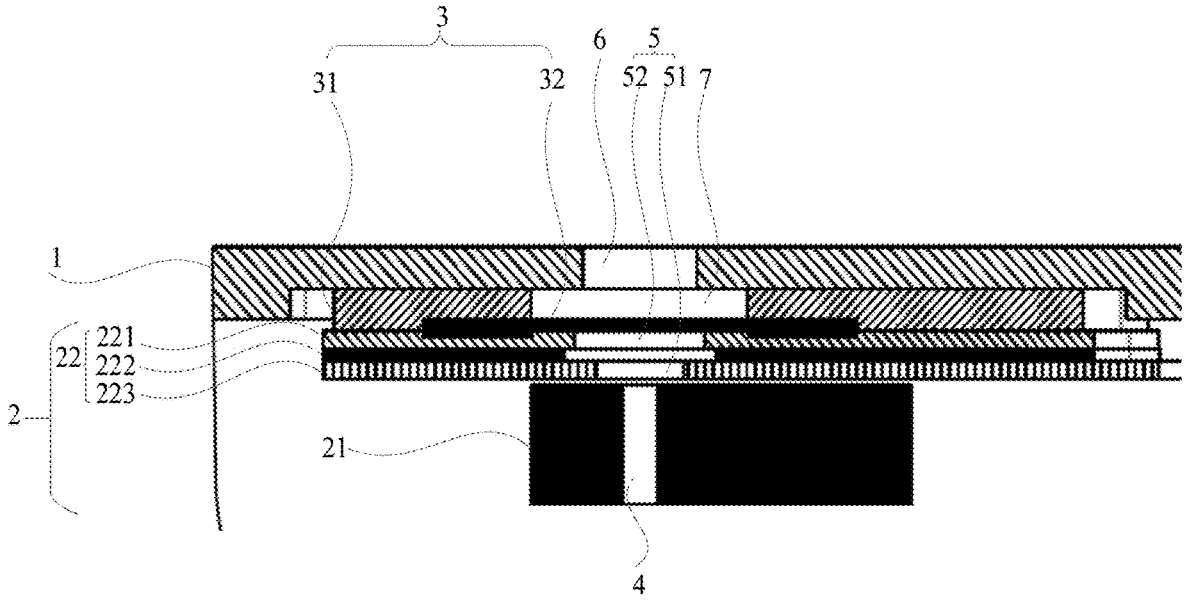
FIG. 1 illustrates a cross-sectional view of an exemplary voice collection device according to some embodiments of the present disclosure.

FIG. 1 illustrates a cross-sectional view of an exemplary voice collection device according to some embodiments of the present disclosure. As shown in FIG. 1, the voice collection device includes a housing 1, a microphone assembly 2 disposed inside the housing 1, and a sealing structure 3 disposed between the microphone assembly 2 and an inner side of the housing 1.

In some embodiments, the microphone assembly 2 includes a microphone main body 21 and a microphone circuit board 22. The sealing structure 3 includes a dust filter 32 and a first adhesive layer 31. One side of the microphone circuit board 22 is connected to the dust filter 32, and both the microphone circuit board 22 and the dust filter 32 are bonded to the inner side of the housing 1 by the first adhesive layer 31. The other side of the microphone circuit board 22 is connected to the microphone main body 21. A sound hole 4 is configured on the microphone main body 21. A first through-hole 5 is configured at a position on the microphone circuit board 22 corresponding to the sound hole 4. A second through-hole 6 is configured at a position on the housing 1 corresponding to the first through-hole 5. The dust filter 32 is configured between the first through-hole 5 and the second through-hole 6. The first through-hole 5, the second through-hole 6, and the sound hole 4 together form a sound pickup main channel.

In some embodiments, the voice collection device may include any device with the high quality sound pickup and small internal space, such as the translation pen and the translation device, etc. The voice collection device may include the housing 1, the microphone assembly 2 disposed inside the housing 1, and the sealing structure 3 disposed between the microphone assembly 2 and the inner side of the housing 1. The sealing structure 3 is configured to seal any gap between the microphone assembly 2 and the housing 1 other than the sound pickup main channel.

In some embodiments, the microphone main body 21 and the microphone circuit board 22 may be two unconnected independent parts at the time of shipment. In a subsequent assembling process, the microphone main body 21 and the microphone circuit board 22 are connected. In some other embodiments, the microphone main body 21 and the microphone circuit board 22 may be connected as a single structure at the time of shipment. No further assembly is required subsequently. The embodiments of the present disclosure do not limit the arrangement of the microphone main body 21 and the microphone circuit board 22.

In some embodiments, the sound hole 4 is configured on the microphone main body 21. The microphone main body 21 picks up sound through the sound hole 4. Correspondingly, the first through-hole 5 is configured at the position on the microphone circuit board 22 corresponding to the sound hole 4. The first through-hole 5 matches the sound hole 4. The second through-hole 6 is configured at the position on the housing 1 corresponding to the first through-hole 5. The second through-hole 6 matches the first through-hole 5. In some embodiments, the sound hole 4, the first through-hole 5, and the second through-hole 6 are in a rounded-shape. Centers of the second through-hole 6, the first through-hole 5, and the sound hole 4 may be located on a same straight line. Each of diameters of the first through-hole 5 and the second through-hole 6 is greater than a diameter of the sound hole 4. The first through-hole 5, the second through-hole 6, and the sound hole 4 together form the sound pickup main channel. The microphone main body 21 picks up the sound through the sound pickup main channel.

In some embodiments, the dust filter 32 is configured between the first through-hole 5 and the second through-hole 6. A coverage area of the dust filter 32 is greater than a cross-sectional area of the first through-hole 5 and a cross-sectional area of the second through-hole 6. The dust filter 32 is configured to block dust and water, thereby preventing external dusts and water from entering the sound hole 4 of the microphone main body 21 and improving product stability. The dust filter 32 is made of a material according to actual requirements. A mesh size of the dust filter 32 is configured according to actual requirements. The embodiments of the present disclosure do not pose any limitations.

In some embodiments, the microphone circuit board 22 and the dust filter 32 are bonded to the inner side of the housing 1 by the first adhesive layer 31. The adhesive layer 31 serves not only the bonding function but also the sealing function to seal off any gap other than the sound pickup main channel. A third through-hole 7 is configured at a position on the first adhesive layer 31 corresponding to the first through-hole 5 (or the second through-hole 6). The third through-hole 7 matches the first through-hole 5 (or the second through-hole 6) and forms the sound pickup main channel along with the second through-hole 6, the first through-hole 5, and the sound hole 4.

In some embodiments, the voice collection device includes the housing 1, the microphone assembly 2 disposed inside the housing 1, and the sealing structure 3 disposed between the microphone assembly 2 and the inner side of the housing 1. The microphone assembly 2 includes the microphone main body 21 and the microphone circuit board 22. The sealing structure 3 includes the dust filter 32 and the first adhesive layer 31. One side of the microphone circuit board 22 is connected to the dust filter 32, and both the microphone circuit board 22 and the dust filter 32 are bonded to the inner side of the housing 1 by the first adhesive layer 31. The other side of the microphone circuit board 22 is connected to the microphone main body 21. The sound hole 4 is configured on the microphone main body 21. The first through-hole 5 is configured at the position on the microphone circuit board 21 corresponding to the sound hole 4. The second through-hole 6 is configured at the position on the housing 1 corresponding to the first through-hole 5. The dust filter 32 is configured between the first through-hole 5 and the second through-hole 6. The first through-hole 5, the second through-hole 6, and the sound hole 4 together form the sound pickup main channel. In some embodiments, the microphone circuit board 22 and the dust filter 32 are bonded to the inner side of the housing 1 by the first adhesive layer 31 to effectively seal any gap other than the sound pickup main channel. Thus, the voice collect device solves the problem that in the existing voice recognition device with the high quality sound pickup, substantial compactness of the internal structure causes poor sealing effect by the silicone seal.

Further, when the sealing is conducted by the silicone seal in the existing technology, a silicone structure for pressing the silicone seal is required. Compared with the existing technology, the embodiments of the present disclosure no longer require the silicone structure for pressing, thereby simplifying the structure and saving space.

The present disclosure solves the problem that the first adhesive layer 31 is difficult to fit in due to the substantial compactness of the internal structure in the existing voice recognition device with the high quality sound pickup. In some embodiments, the first adhesive layer 31 may be placed in various manners. For example, one portion of the first adhesive layer 31 is configured between the dust filter 32 and the housing 1 and another portion is configured between the microphone circuit board 22 and the housing 1. In another example, one portion of the first adhesive layer 31 is configured between the dust filter 32 and the microphone circuit board 22 and another portion is configured between the microphone circuit board 22 and the housing 1.

During an assembling process, the sound hole 4 disposed on the microphone main body 21 is aligned with the first through-hole 5 disposed on the microphone circuit board 22. Then, the microphone main body 21 is connected to the microphone circuit board 22. For example, the microphone main body 21 is soldered onto the microphone circuit board 22 by a soldering material. Then, the microphone circuit board 22 and the dust filter 32 are bonded to the inner side of the housing 1. For example, a glue is applied to the dust filter 32 other than an area matching the first through-hole 5. After the matching area of the dust filter 32 is aligned with the first through-hole 5, the dust filter 32 is attached to the microphone circuit board 22. After the glue is tightly pressed, the dust filter 32 is tentatively fixed to the microphone circuit board 22. The glue is then applied to the inner side of the housing 1 other than an area matching the second through-hole 6 (the glue-applied area may be greater than the area of the dust filter 32, but may not be greater than the area of the microphone circuit board 22). After the first through-hole 5 is aligned with the second through-hole 6, the microphone circuit board 22 and the dust filter 32 are attached to the inner side of the housing 1. After the glue is tightly pressed, the first adhesive layer 31 is formed and the microphone circuit board 22 and the dust filter 32 are bonded to the inner side of the housing 1. In another example, the dust filter 32 covers the second through-hole 6 disposed on the inner side of the housing 1. Then, the glue is applied to one side of the dust filter 32 not contacting the housing 1 (the glue is applied to the dust filter 32 other than the area matching the second through-hole 6) and to the inner side of the housing 1 other than the area matching the second through-hole 6 (the glue-applied area may not be greater than the area of the microphone circuit board 22). After the first through-hole 5 on the microphone circuit board 22 is aligned with the second through-hole 6 on the housing 1, the microphone circuit board 22 is attached to the dust filter 32 and the inner side of the housing 1. After the glue is tightly pressed, the first adhesive layer 31 is formed. The microphone circuit board 22 and the dust filter 32 are bonded to the inner side of the housing 1.

In some embodiments, the microphone main body is a bottom sound inlet aperture microphone.

In some embodiments, the microphone circuit board 22 includes a flexible printed circuit (FPC) 223 and a reinforcing board 221. The FPC 223 is attached to the reinforcing board 221. The microphone main body 21 is attached to the FPC 223. As such, the microphone main body 21 is connected to the microphone circuit board 22. The microphone circuit board 22 also includes a second adhesive layer 222. The FPC 223 is bonded to the reinforcing board 221 by the second adhesive layer 222. The microphone main body 21 may be mounted on the FPC 223 by soldering. A first sub-through-hole 51 is configured on the FPC 223 and a second sub-through-hole 52 is configured on the reinforcing board 221. The first sub-through-hole 51 and the second sub-through-hole 52 together form the first through-hole 5. Further, a through-hole is configured on the second adhesive layer 222 matching the first sub-through-hole 51 (or the second sub-through-hole 52).

In some embodiments, the reinforcing board 221 is connected to the dust filter 32. As such, the microphone circuit is connected to the dust filter 32 and is bonded to the inner side of the housing 1 through the reinforcing board 221. Thus, the microphone circuit board 22 is bonded to the inner side of the housing 1.

In some embodiments, the reinforcing board 221 is used as a frame. On one hand, the reinforcing board 221 provides support for bonding the microphone main body 21 to the FPC 223. On the other hand, the reinforcing board 221 provides a flat adhesive area with a sufficient size for bonding the FPC 223 to the inner side of the housing 1.

Figure 2:
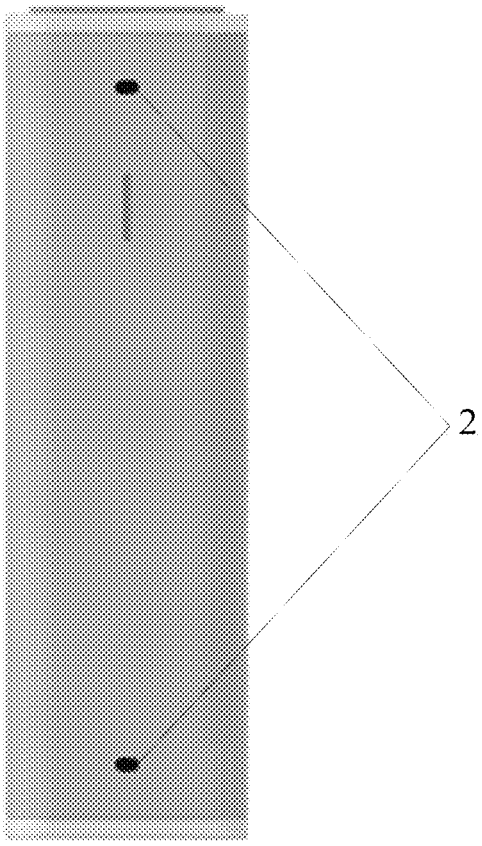
FIG. 2 illustrates a schematic view of microphone placement in an exemplary voice collection device according to some embodiments of the present disclosure.

In some embodiments, the voice collection device may include a plurality of microphone assemblies 2. The plurality of microphone assemblies 2 may be distributed at each end of the voice collection device. In one embodiment, the voice collection device includes two microphone assemblies 2. The two microphone assemblies 2 are distributed at two ends of the voice collection device. In another embodiment, the two microphone assemblies 2 may be located on a same side of the voice collection device and may be separated by a pre-set distance. The pre-distance may be determined according to actual requirement, which is not limited by the present disclosure. FIG. 2 illustrates a schematic view of microphone placement in an exemplary voice collection device according to some embodiments of the present disclosure. As shown in FIG. 2, the two microphone assemblies 2 are distributed at the top and bottom ends on a same side of the voice collection device.

In some embodiments, the two microphone assemblies 2 may also be distributed at the right and left ends on the same side of the voice collection device. In some other embodiments, the two microphone assemblies 2 may also be distributed on different sides of the voice collection device. The present disclosure does not pose any limitation.

In some embodiments, when there is only one microphone circuit board 22, the microphone circuit board 22 may be connected to two microphone main bodies 21 to form two microphone assemblies 2.

While preferred embodiments of the present disclosure have been described, it is apparent that those skilled in the art can make further changes and modifications to the embodiments. Thus, the appended claims are intended to be interpreted as including all changes and modifications.

Further, it should be noted that, terms such as "comprise", "include", or any other variations thereof are intended to encompass a non-exclusive inclusion, such that a process, a method, an article, or a terminal device includes not only listed features or elements, but also other unlisted features or elements, and also includes features or elements inherent to such process, method, article, or terminal device. Without further limitation, a feature or element defined by the phrase "comprising a" does not exclude the presence of additional identical or similar features or elements in the process, the method, the article, or the terminal device that comprises the feature or element.

The foregoing descriptions are merely some implementation manners of the present disclosure, but the scope of the present disclosure is not limited thereto. Without departing from the spirit and principles of the present disclosure, any modifications, equivalent substitutions, and improvements, etc. shall fall within the scope of the present disclosure. Thus, the scope of present disclosure should be determined by the appended claims.

What is claimed is:

1. A voice collection device, comprising:

a housing;

a microphone assembly disposed inside the housing and including a microphone main body and a microphone circuit board; and a sealing structure disposed between the microphone assembly and an inner side of the housing and including a dust filter and a first adhesive layer, wherein one side of the microphone circuit board is connected to the dust filter, an opposing side of the microphone circuit board is connected to the microphone main body, the microphone circuit board and the dust filter are bonded to the inner side of the housing, a sound hole is configured on the microphone main body, a first through-hole is configured on the microphone circuit board corresponding to the sound hole, a second through-hole is configured on the housing corresponding to the first through-hole; the dust filter is configured between the first through-hole and the second through-hole, and the first through-hole, the second through-hole, and the sound hole collectively form a sound pickup main channel, wherein the microphone circuit board includes a flexible circuit board (FPC), a second adhesive layer, and a reinforcing board, the FPC is attached to the reinforcing board through the second adhesive layer, the microphone main body is mounted on the FPC, and the reinforcing board is connected to the dust filter, and wherein the FPC defines a first sub-through-hole, the reinforcing board defines a second sub-through-hole, the second adhesive layer defines a third sub-through-hole, the first, the second, and the third sub-through-holes collectively form the first through-hole, and the third sub-through-hole is of an opening size greater than an opening size of the first sub-through-hole or greater than an opening size of the second sub-through-hole.

2. The voice collection device of claim 1, wherein one portion of the first adhesive layer is configured between the dust filter and the housing, and another portion of the first adhesive layer is configured between the microphone circuit board and the housing.

3. The voice collection device of claim 1, wherein one portion of the first adhesive layer is configured between the dust filter and the microphone circuit board, and another portion of the first adhesive layer is configured between the microphone circuit board and the housing.

4. The voice collection device of claim 1, wherein the microphone main body is a bottom sound inlet aperture microphone.

5. The voice collection device of claim 1, wherein the microphone assembly is a first microphone assembly, and the voice collection device further comprising:

a second microphone assembly, wherein the first and the second microphone assemblies are distributed at two opposite ends of the voice collection device.

6. The voice collection device of claim 5, wherein the first and the second microphone assemblies are located on a same side of the voice collection device and are separated by a pre-set distance.

7. The voice collection device of claim 6, wherein the microphone circuit board is connected to two microphone main bodies respectively to form the first and the second microphone assemblies.

8. The voice collection device of claim 1, wherein the microphone assembly is a first microphone assembly, and the voice collection device further comprising:

a second microphone assembly, wherein the first and the second microphone assemblies are located on a same side of the voice collection device and are separated by a pre-set distance.

9. The voice collection device of claim 8, wherein the microphone circuit board is connected to two microphone main bodies respectively to form the first and the second microphone assemblies.

10. The voice collection device of claim 1, wherein at least a portion of the reinforcing board is positioned between the FPC and the dust filter.

11. A voice collection device, comprising:

a housing;

a microphone assembly including a microphone main body and a microphone circuit board, wherein the microphone circuit board includes a flexible printed circuit (FPC), a second adhesive layer, and a reinforcing board; and a sealing structure including a dust filter and a first adhesive layer, the dust filter being positioned between the microphone circuit board and the housing, wherein the microphone main body defines a sound hole, the microphone circuit board defines a first through-hole, the housing defines a second through-hole, and the first through-hole, the second through-hole, and the sound hole collectively form a sound pickup main channel, and wherein the FPC defines a first sub-through-hole, the reinforcing board defines a second sub-through-hole, the second adhesive layer defines a third sub-through-hole, the first, the second, and the third sub-through-holes collectively form the first through-hole, and the third sub-through-hole is of an opening size greater than an opening size of the first sub-through-hole or greater than an opening size of the second sub-through-hole.

12. The voice collection device of claim 11, wherein one portion of the first adhesive layer is positioned between the dust filter and the housing, and another portion of the first adhesive layer is positioned between the microphone circuit board and the housing.

13. The voice collection device of claim 11, wherein one portion of the first adhesive layer is positioned between the dust filter and the microphone circuit board, and another portion of the first adhesive layer is positioned between the microphone circuit board and the housing.

14. The voice collection device of claim 11, wherein the reinforcing board is positioned between the FPC and the dust filter.

15. The voice collection device of claim 11, wherein the second adhesive layer positioned between the FPC and the reinforcing board.

16. A microphone assembly to be assembled with a sealing structure to form a voice collection device, the microphone assembly comprising:

a microphone main body; and a microphone circuit board including a flexible printed circuit (FPC), a second adhesive layer, and a reinforcing board, a sealing structure including a dust filter and a first adhesive layer, the dust filter being positioned between the microphone circuit board and the housing, wherein the microphone main body defines a sound hole, the microphone circuit board defines a first through-hole, the first through-hole and the sound hole collectively form a sound pickup main channel, the FPC defines a first sub-through-hole, the reinforcing board defines a second sub-through-hole, the second adhesive layer defines a third sub-through-hole, the first, the second, and the third sub-through-holes collectively form the first through-hole, and the third sub-through-hole is of an opening size greater than an opening size of the first sub-through-hole or greater than an opening size of the second sub-through-hole.

* * * * *